US009074418B2

(12) United States Patent
Thompson et al.

(10) Patent No.: US 9,074,418 B2
(45) Date of Patent: Jul. 7, 2015

(54) DOOR FACING ALIGNMENT ASSEMBLY AND METHOD OF FORMING A DOOR

(75) Inventors: Douglas Thompson, Tampa, FL (US); Jason Walsh, Batavia, IL (US)

(73) Assignee: Masonite Corporation

( * ) Notice: Subject to any disclaimer, the term of this patent is extended or adjusted under 35 U.S.C. 154(b) by 1325 days.

(21) Appl. No.: 12/539,933

(22) Filed: Aug. 12, 2009

(65) Prior Publication Data

US 2011/0036036 A1 Feb. 17, 2011

(51) Int. Cl.

| | |
|---|---|
| ***E06B 3/70*** | (2006.01) |
| ***E06B 3/72*** | (2006.01) |
| *E06B 3/76* | (2006.01) |
| *E06B 3/78* | (2006.01) |

(52) U.S. Cl.

CPC ..... *E06B 3/7001* (2013.01); *Y10T 29/49936* (2015.01); *E06B 3/72* (2013.01); *E06B 3/76* (2013.01); *E06B 3/78* (2013.01); *E06B 2003/7049* (2013.01)

(58) Field of Classification Search

CPC ..... E06B 3/7001; E06B 3/72; E06B 3/78; E06B 2003/7049; Y10T 29/49936

USPC ..... 52/455, 456, 784.1, 783.1, 784.15, 52/789.1, 98, 100

See application file for complete search history.

(56) References Cited

U.S. PATENT DOCUMENTS

| | | | | |
|---|---|---|---|---|
| 4,311,183 | A | 1/1982 | Herbst et al. | |
| 4,327,535 | A * | 5/1982 | Governale | 52/309.11 |
| 4,860,512 | A | 8/1989 | Thorn | |
| 4,965,030 | A | 10/1990 | Thorn | |
| 5,269,111 | A * | 12/1993 | McDougall | 52/455 |
| 5,634,508 | A * | 6/1997 | Herbst | 160/371 |
| 5,887,398 | A | 3/1999 | Chen | |
| 5,894,706 | A * | 4/1999 | Herbst | 52/782.1 |
| 5,901,768 | A | 5/1999 | Herbst | |
| 6,161,363 | A | 12/2000 | Herbst | |
| 6,311,454 | B1 | 11/2001 | Kempel | |
| 6,602,610 | B2 | 8/2003 | Smith et al. | |
| 6,694,701 | B2 | 2/2004 | Wang et al. | |
| 6,925,767 | B2 * | 8/2005 | Krochmal et al. | 52/455 |
| 2004/0083678 | A1 * | 5/2004 | Tumlin et al. | 52/717.01 |
| 2005/0028465 | A1 * | 2/2005 | Horsfall et al. | 52/455 |
| 2006/0144014 | A1 | 7/2006 | Yoon et al. | |
| 2007/0113520 | A1 * | 5/2007 | Lynch et al. | 52/783.1 |
| 2007/0160812 | A1 | 7/2007 | Pickens et al. | |
| 2007/0175041 | A1 | 8/2007 | Hardwick et al. | |
| 2008/0245003 | A1 | 10/2008 | Kon et al. | |
| 2008/0254243 | A1 * | 10/2008 | Turner | 428/34.1 |
| 2009/0193738 | A1 * | 8/2009 | Kortuem et al. | 52/302.1 |

FOREIGN PATENT DOCUMENTS

| | | |
|---|---|---|
| WO | WO 2005/116386 | 12/2005 |

* cited by examiner

*Primary Examiner* — Brian Glessner
*Assistant Examiner* — Jessie Fonseca
(74) *Attorney, Agent, or Firm* — Berenato & White, LLC

(57) ABSTRACT

A door facing is provided. The door facing includes a body portion, and male and female alignment members protruding from a main surface area of the body portion. Also provided are door assemblies including the door facing and methods of making the door facing and the door assembly.

30 Claims, 7 Drawing Sheets

DOOR FACING ALIGNMENT ASSEMBLY AND METHOD OF FORMING A DOOR

FIELD OF THE INVENTION

The invention relates to door facings. Specifically, the invention relates to door facings having alignment assemblies and methods for forming a door utilizing door facings having alignment assemblies.

BACKGROUND

Molded door facings and molded door assemblies are well known in the art. To form a door assembly, two separate door facings are molded and then attached to opposite sides of a frame. The door facings may be molded from a variety of materials such as polymers, wood composites, or metals. Depending on the application, the frame may be hollow or of a solid (non-hollow) construction. Hollow frames may be filled with a core component, such as corrugated cardboard, paper, fiberboard, insulation or foam. The core component may be selected to provide such benefits as added weight, impact resistance, noise reduction, temperature control and fire resistance.

A variety of different shapes and designs of door facings have been manufactured over the years. The advances in this field have been driven by the desire to economically provide an authentic-looking door having portions simulating the stiles, rails and panels found in traditional wooden doors. Methods have been developed to give door facings such designs elements at the time that the facings are molded or through subsequent processing operations. In addition to having different panels and designs, door facings are often provided with openings in which a window may be secured. Though molded doors may be cheaper than traditional solid wood doors, manufacturing molded door facings can still be costly.

When attaching the door facings to their frame, great care must be taken in order to ensure proper alignment. Misalignment may result in the rails or stiles of the door frame being unaligned (e.g., frame members protruding beyond the edges of the door facings) or may simply give the door a crooked appearance. A number of methods to assist in the alignment of door facings have been developed. Generally, such methods involve placing male alignment assemblies at multiple positions, usually around the edge, of one of the door facings, and positioning corresponding female alignment assemblies on the opposite door facing to mate with the male alignment assemblies.

SUMMARY

According to a first aspect of the invention, a door facing is provided. The door facing features a body portion including a first surface with a substantially planar main surface area, and an oppositely disposed second surface. Male and female alignment members protrude relative to the substantially planar main surface area. The male and female alignment members are constructed and arranged so that, when the door facing is placed in opposing relationship with a second door facing having counterpart male and female alignment members to the door facing, the male and female alignment members of the door facing align and mate with the counterpart female and male alignment members, respectively.

A second aspect of the invention features a door facing featuring a body portion including a first surface having a substantially planar main surface area, and an oppositely disposed second surface. A first set of alignment members including a first male alignment member and a first female alignment member protrude relative to the substantially planar main surface area. A second set of alignment members including a second male alignment member and a second female alignment member protrude relative to the substantially planar main surface area. The first and second sets of alignment members are constructed and arranged so that, when the door facing is placed in opposing relationship with a second door facing having counterpart first and second male alignment members and counterpart female alignment members, the male and female alignment members of the door facing align and mate with the counterpart female and male alignment members, respectively.

A third aspect of the invention features a door assembly including a first and a second door facing. The first door facing features a first body portion including a first interior surface with a first substantially planar main surface area, and an oppositely disposed first exterior surface. A first male and a first female alignment member protrude relative to the first substantially planar main surface area. The second door facing includes a second body portion having a second interior surface with a second substantially planar main surface area, and an oppositely disposed second exterior major surface. Second male and first female alignment members protrude relative to the second substantially planar main surface area, and mate with the first female and first male alignment members, respectively.

According to a fourth aspect of the invention, a method of making a door assembly is provided. First and second door facings are placed in opposing relationship to one another. The first door facing includes a body portion having a first interior surface with a first substantially planar main surface area and an oppositely disposed first exterior surface, and first male and female alignment members protruding relative to the first substantially planar main surface area. The second door facing includes a second body portion having a second interior surface with a second substantially planar main surface area and an oppositely disposed second exterior surface, and second male and female alignment members protruding relative to the second substantially planar main surface. The first male and female alignment members are mated with the second female and male alignment members, respectively.

Other aspects of the invention, including apparatus, systems, methods, and the like which constitute part of the invention, will become more apparent upon reading the following detailed description of the exemplary embodiments and viewing the drawings.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. In such drawings.

DETAILED DESCRIPTION OF EXEMPLARY EMBODIMENTS AND EXEMPLARY METHODS

Figure 1:
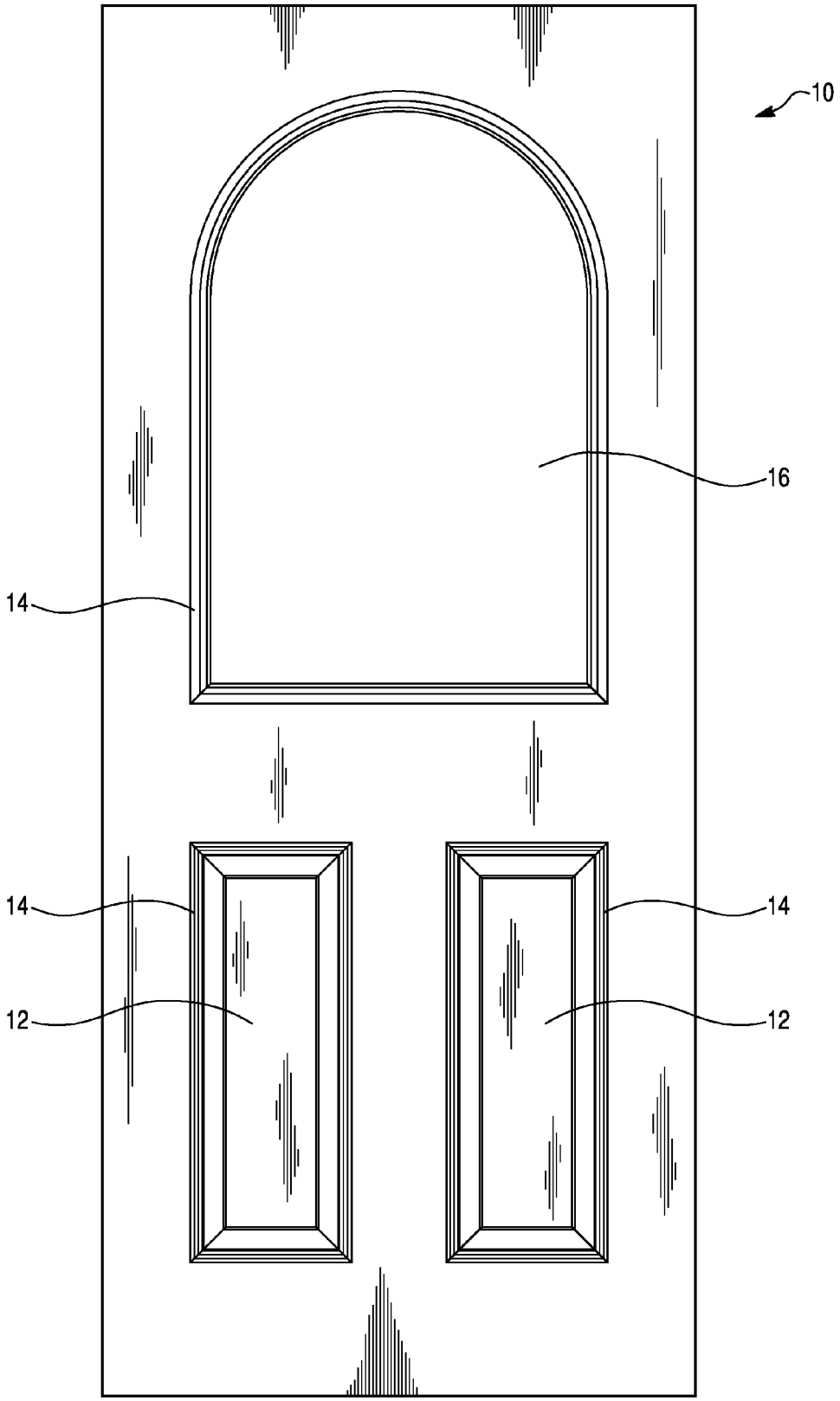
FIG. 1 is a plan view of an exterior surface of a molded door facing of a door assembly according to an exemplary embodiment of the invention.

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

As shown in FIG. 1, a finished molded door facing 10 according to an exemplary embodiment of the invention includes design elements such as a plurality of interior panels 12, trim 14 in the form of contoured depressed areas surrounding the interior panels 12, and a window opening 16. The opening 16 may house one or more window inserts of any size and shape. The door facing 10 may be formed out of metal, or molded from a wood composite material or a thermoset or thermoplastic polymer. In an exemplary embodiment the door facing 10 is preferably a sheet molding compound (SMC) made out of a fiberglass-reinforced thermoset polymer. It should be understood that the design elements shown in FIG. 1 are provided by way of example only. Molded door facings according to embodiments of the invention may include one, two, three, or more of each of such interior panels 12, trim 14, and openings 16. The molded door facings described herein alternatively may omit one or more of the illustrated design elements, or may contain other design elements and combinations of design elements.

Typically, a first molded door facing and a second molded door facing are respectively attached to opposite sides of a frame to construct a door assembly. One facing is on the interior and the other on the exterior of the door assembly. The frame may be made of the same or different materials than the molded door facings. Frames may be formed of wood, metal, or molded materials, for example. The door facings each possess an "interior" surface facing the frame and an "exterior" surface facing away from the frame. Depending upon the application, sometimes the door facing which faces inside of a room or building is referred to as the interior door facing, and the door facing which faces away from the inside of a room or building is referred to as the exterior door facing.

For reasons of attractiveness and perceived quality, it is desirable that the peripheral edges of both door facings align with each other and with the outer edge of the frame. Otherwise, the final door assembly will have an aesthetically unpleasing appearance. In some instances, the misalignment of the door facings may be so great that it leaves the door assembly unsuited for commercial use or sale.

Figure 2:
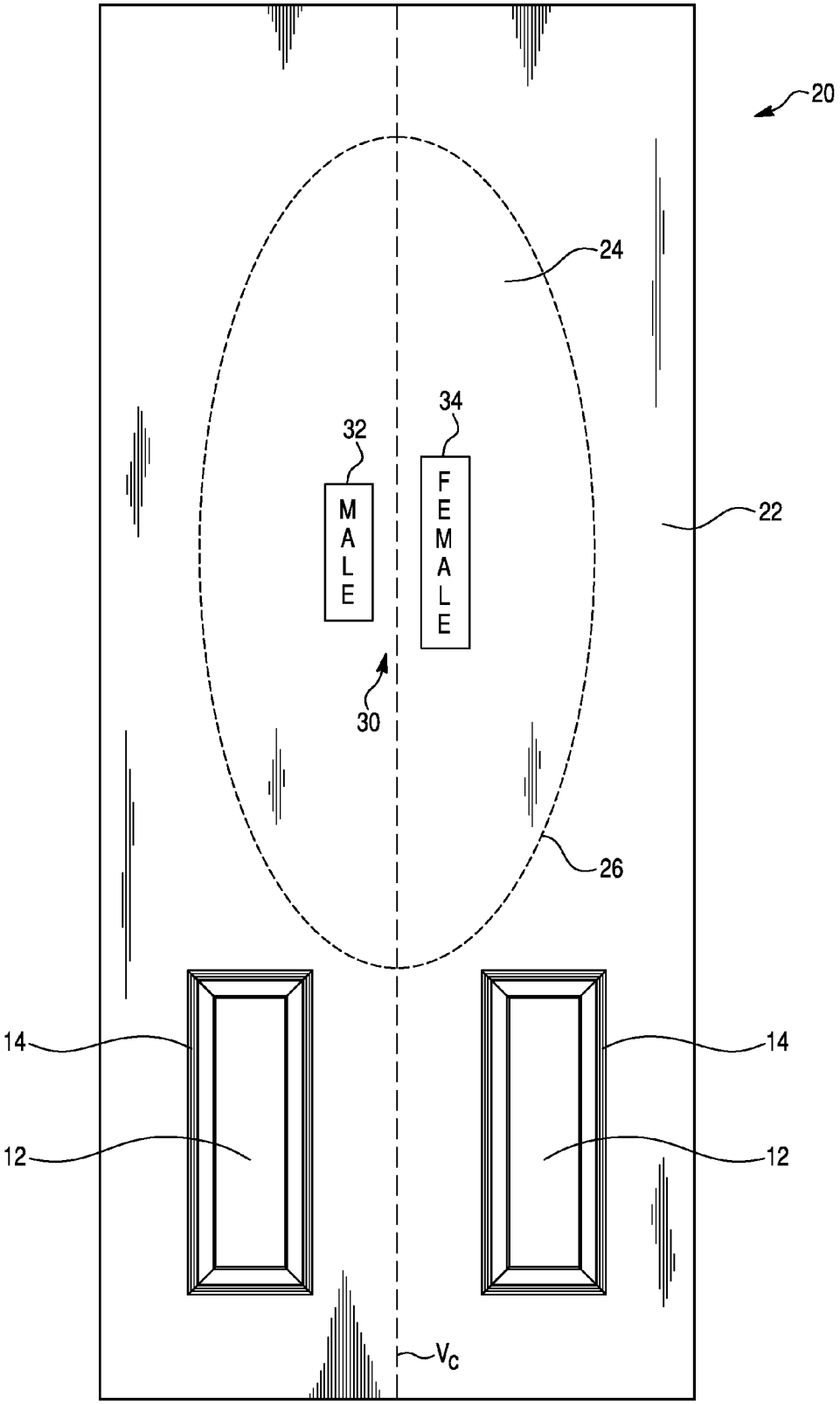
FIG. 2 is a plan view of the door facing of FIG. 1, illustrated in a pre-finished state.

In order to prevent door facing misalignment during fabrication, exemplary embodiments of door facings discussed below include one or more sets of alignment members. As best shown in FIG. 2, a pre-finished first door facing 20 has a substantially planar main body portion with a peripheral or marginal area 22 surrounding an inner area 24. As referred to herein, substantially planar does not necessarily mean a flush door facing. The door facing may contain various design elements such as interior panels 12 and surrounding trim 14.

A set of alignment members 30 is positioned in the inner area 24 of the door facing 20. The set of alignment members 30 shown in the embodiment of FIG. 2 include a male alignment member 32 and a female alignment member 34. For simplification of explanation, the alignment members 32, 34 are represented in FIG. 2 by reference boxes. Specific constructions for such alignment members 32, 34 are explored in greater detail below in connection with the description of other embodiments of the invention.

The set of alignment members 30 of this exemplary embodiment may be integrally molded with the door facing 20 so as to form part of a monolithic structure with the main body portion of the door facing 20. The door facing 20 may be molded by any suitable molding technique, including conventional molding techniques for same. In an exemplary embodiment the door facing 20 is compression molded using a male die and a female die. The male alignment member 32 and female alignment member 34 are positioned in vertical symmetry with one another on opposite sides of an imaginary central vertical line $V_c$ of the door facing 20.

When forming a door assembly, a second door facing which may be substantially identical to the first door facing 20 is provided, and the first and second door facings are respectively attached, typically by an adhesive, to opposite sides of a frame. Due to their vertical symmetry, the male alignment member 32 of the first door facing 20 is aligned with the female alignment member 34 of the second door facing, and the female alignment member 34 of the first door facing 20 is aligned with the male alignment member 32 of the second door facing. The depth of the alignment members 30 is selected so that, when the first and second door facings are mounted on opposite sides of the door frame, the male and female alignment members 32, 34 of the first door facing 20 respectively mate with the female and male alignment members 34, 32 of the second door facing.

After the first and second door facings are aligned and secured to the frame with the alignment members 32, 34 in mating relationship, the inner section 24 may then be removed to provide an opening having a periphery corresponding in location to the dashed line 26. In FIG. 2, the opening 24 is elliptical, though any size or shape of an opening may be formed. The mated alignment members 32, 34 of the first and second door facings will be removed with the inner section 24. A continuous or non-continuous indentation or perforation coinciding with the dashed line 26 may be molded or imprinted into the body portion of the door facing 20 to facilitate removal of the inner section 24.

Figure 3:
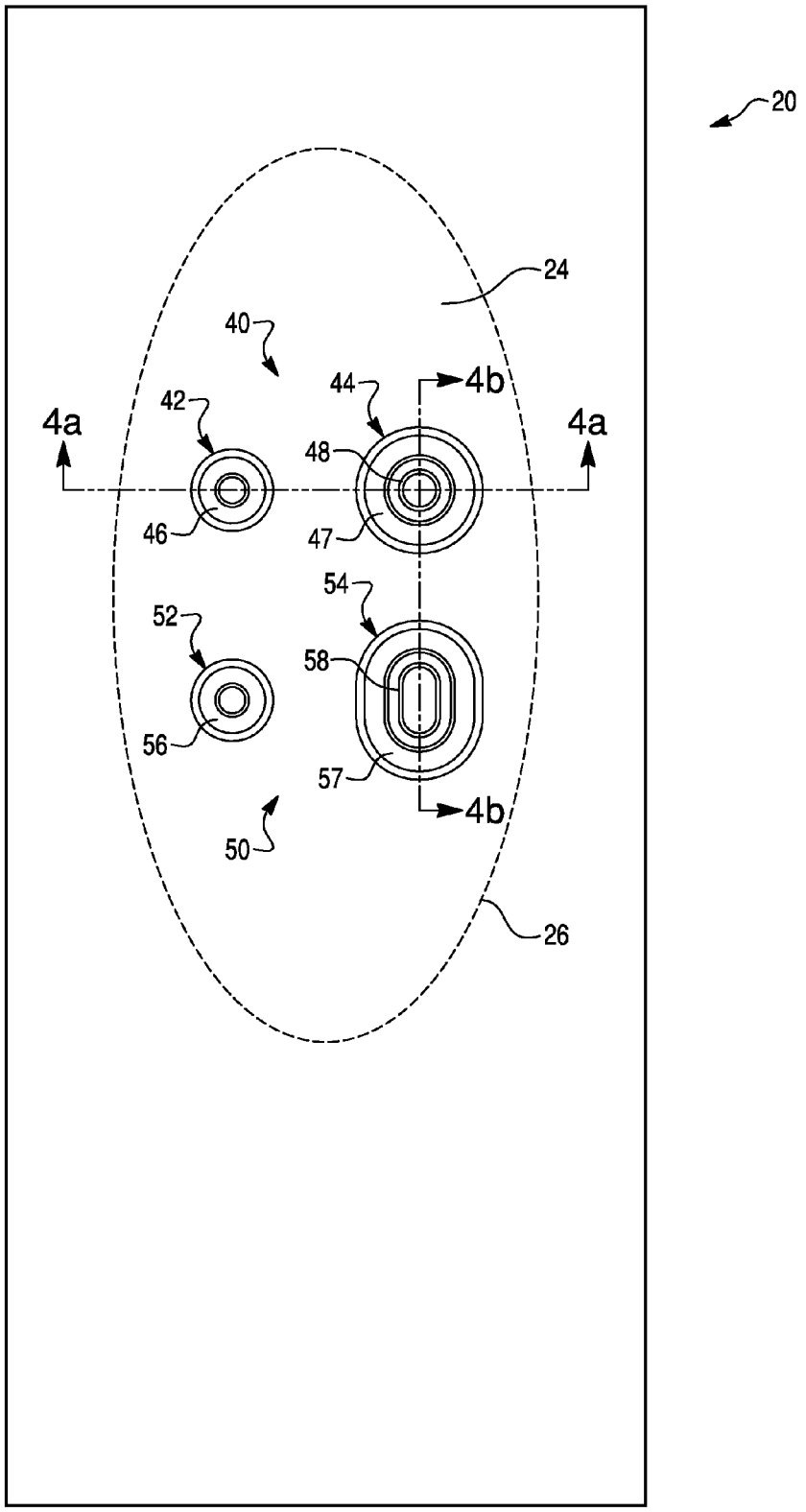
FIG. 3 is a plan view of another exemplary door facing having a plurality of sets of alignment members.

As best shown in FIG. 3, the inner section 24 of the first door skin 20 may contain a first set of alignment members 40 and a second set of alignment members 50, which correspond to the alignment members 32, 34 of FIG. 2. Each set of alignment members 40, 50 has a male alignment member 42, 52 and a female alignment member 44, 54. The male alignment member 42 of the first set of alignment members 40 may comprise a circular pin, and the female alignment member 44 of the first set of alignment members 40 may comprise a circular locator. The male alignment member 52 of the second set of alignment members 50 may also comprise a circular pin, and the female alignment member 54 of the second set of alignment members 50 may comprise an obround locator. The first set of alignment members 40 prevents movement of the door facing in the X and Y direction. Due to tolerances, there may be play in the first alignment members 40, resulting in unwanted rotation of the door facings. To minimize this issue a second set of alignment members 50 may be used to prevent the door facings from rotating with respect to one another.

To ease the alignment between the facings, the female alignment member 54 of the second set of alignment members 50 may have a length greater than the diameter of the circular male alignment member 52. Because the second set of alignment members 50 prevents rotation of the respective door facings, the female alignment member 54 need only have a width substantially equal to the diameter of the circular male alignment member 52. As such, one of ordinary skill in the art would know that a variety of shapes may be used for the female alignment member 54 of the second set of alignment members 50, such as an oval, elliptical, or rectangular projection.

Figure 4A:
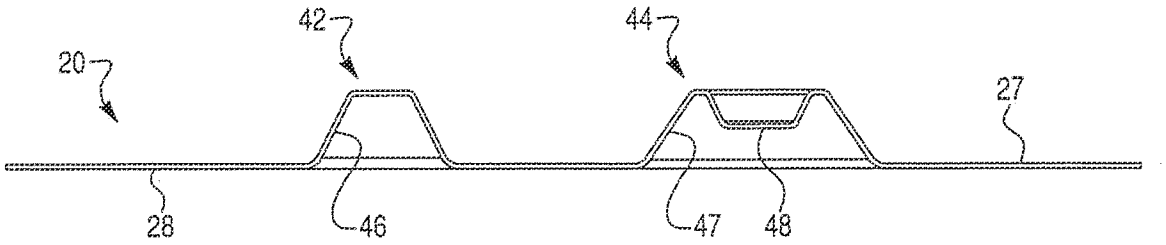
FIGS. 4*a* and 4*b* are sectional views taken alone sectional lines 4*a*-4*a* and 4*b*-4*b*, respectively, of FIG. 3.
Figure 4B:
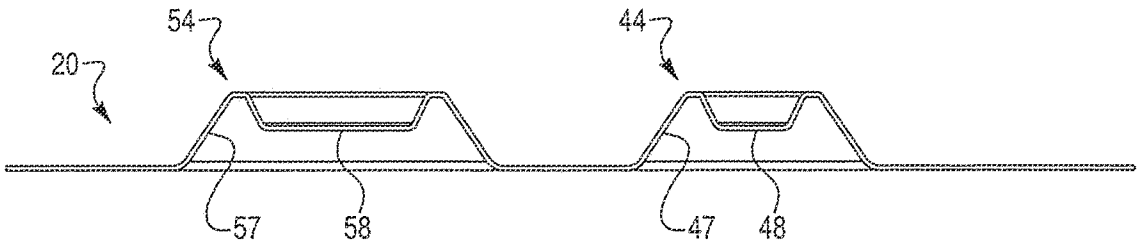

FIGS. 4*a* and 4*b* show sectional views of the sets of alignment members 40, 50 of the embodiment illustrated in FIG. 3. The door facing 20 has an interior surface 27 which generally lies in a first plane, and an exterior surface 28 which generally lies in a second parallel plane. The sets of alignment members 40, 50 are integrally molded as part of a larger monolithic structure including surfaces 27 and 28. The sets of alignment members 40, 50 project interiorly from the first plane of the interior surface 27. The male alignment members 42, 52 and the female alignment members 44, 54 similarly extend interiorly from the first plane of the interior surface 27 to mate with counterpart female and male alignment members extending from an interior surface of an opposing door facing (see FIG. 5). This protruding depth of the male and female alignment members 42, 44, 52, 54 may be selected to match the desired thickness of the core area of the door assembly.

As best shown in FIGS. 3 and 4*a* and 4*b*, the male alignment members 42, 52 may comprise hollow frusto-conical pins 46, 56, respectively. Male alignment member 52 in this embodiment being identical to the male alignment member 42 illustrated in FIG. 4*a*. Female alignment member 44 may comprise a frusto-conical locator 47 having an inwardly facing frusto-conical detent 48. The detent 48 is designed to mate with a counterpart male alignment member located on an interior surface of a door face mounted to the opposite side of a frame. Similarly, the female alignment member 54 may comprise a frusto-obround locator 57 having an inwardly facing frusto-obround detent 58. The frustum of any of the male projections or any of the female detents may be removed after molding by a cutting operation. For example the frustum of the inwardly facing frusto-conical detent 48 may be removed so that a portion of the pin 46 may pass through the detent 48. Though the embodiments shown in the figures and discussed herein are directed to curvilinear projections, those skilled in the art will understand that a number of different shapes and styles of projections may be used in practice.

Figure 5:
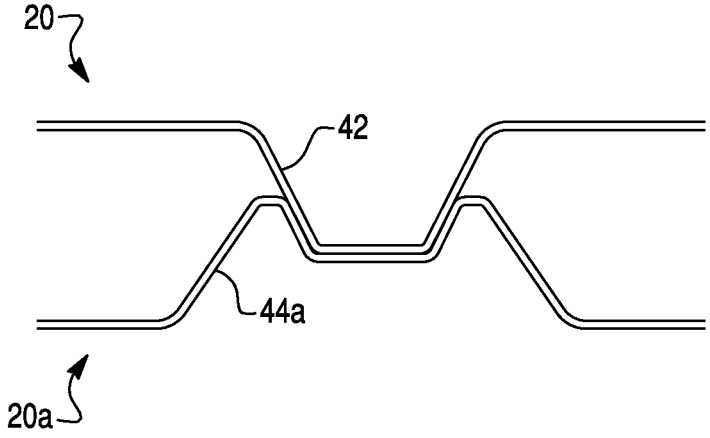
FIG. 5 is a fragmented sectional view of the exemplary door facing of FIG. 3 mated with a corresponding set of alignment members of another door facing.

FIG. 5 shows first and second door facings 20, 20*a* positioned in mutual mating engagement as will exist when the door facings 20, 20*a* are mounted on opposite sides of a door frame (not shown in FIG. 5). The male alignment member 42 of the first door facing 20 is mated with the opposed counterpart female alignment member 44*a* of the second door facing 20*a*. The female alignment member 44 of the first door facing 20 is simultaneously mated with the opposed counterpart male alignment member 42*a* of the second door facing 20*a*.

The first and second door facings 20, 20*a* of the embodiment illustrated in FIGS. 4*a*, 4*b*, and 5 each possess both male and female alignment members. The male and female alignment members, e.g., 42 and 44, are vertically symmetrically positioned on their respective door facings 20, 20*a*. As a consequence of this vertical symmetry, when the door facings 20, 20*a* are properly arranged on opposite sides of a door frame, the male and female alignment members 42, 44 of the first door facing 20 are aligned with the female and male alignment members of the second door facing 20*a*. This alignment feature provides advantages of lower tool costs and simplified manufacture over door assembles requiring a die for molding door facings with a male portion and a separate die for molding door facings having a female portion.

Figure 6:
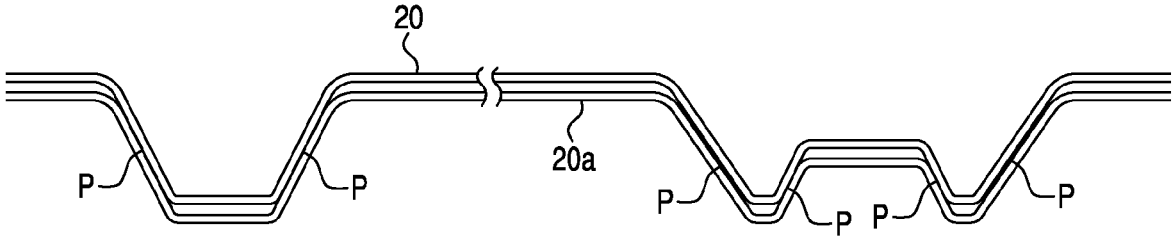
FIG. 6 is a fragmented sectional view of two exemplary door facings nested together.

Another advantage of the above-discussed exemplary embodiment is best shown in FIG. 6. The facings 20, 20*a* nest together when stacked on top of each other, reducing the space needed to store and transport multiple door facings 20, 20*a* compared to non-nesting facings. When nesting, the door facings 20, 20*a* only come in contact with each other at their respective alignment members. In the embodiment illustrated in FIG. 6, contact between stacked door facings 20, 20*a* is limited to the angular/tapering faces of the respective alignment members, designated in FIG. 6 by reference character P. This feature is especially advantageous in embodiments where the alignment members and contacting areas or points P are positioned within an area corresponding to the inner section 24 to be removed. Any damage that may occur during storage or transport of the door skins should be limited to the contacting points P between the door facings 20, 20*a*. Such damage will be immaterial, because the damaged areas (that is the contacting alignment members) will be removed with inner section 24 during processing, and will not constitute part of the finished product.

Though the use of identical door facings may best take advantage of the present invention, the principals and methods described above may be applied to door assemblies having non-identical door facings on opposite sides of a frame. For example, non-identical door facings may be desired where the interior door facing is to have a different pattern or design elements, or is to be made from a different material than the exterior door facing. Accordingly, different facings and alignment members may be used to fabricate a door assembly as long as the alignment members of the respective door facings will mate with each other to reduce or prevent misalignment.

Figure 7:
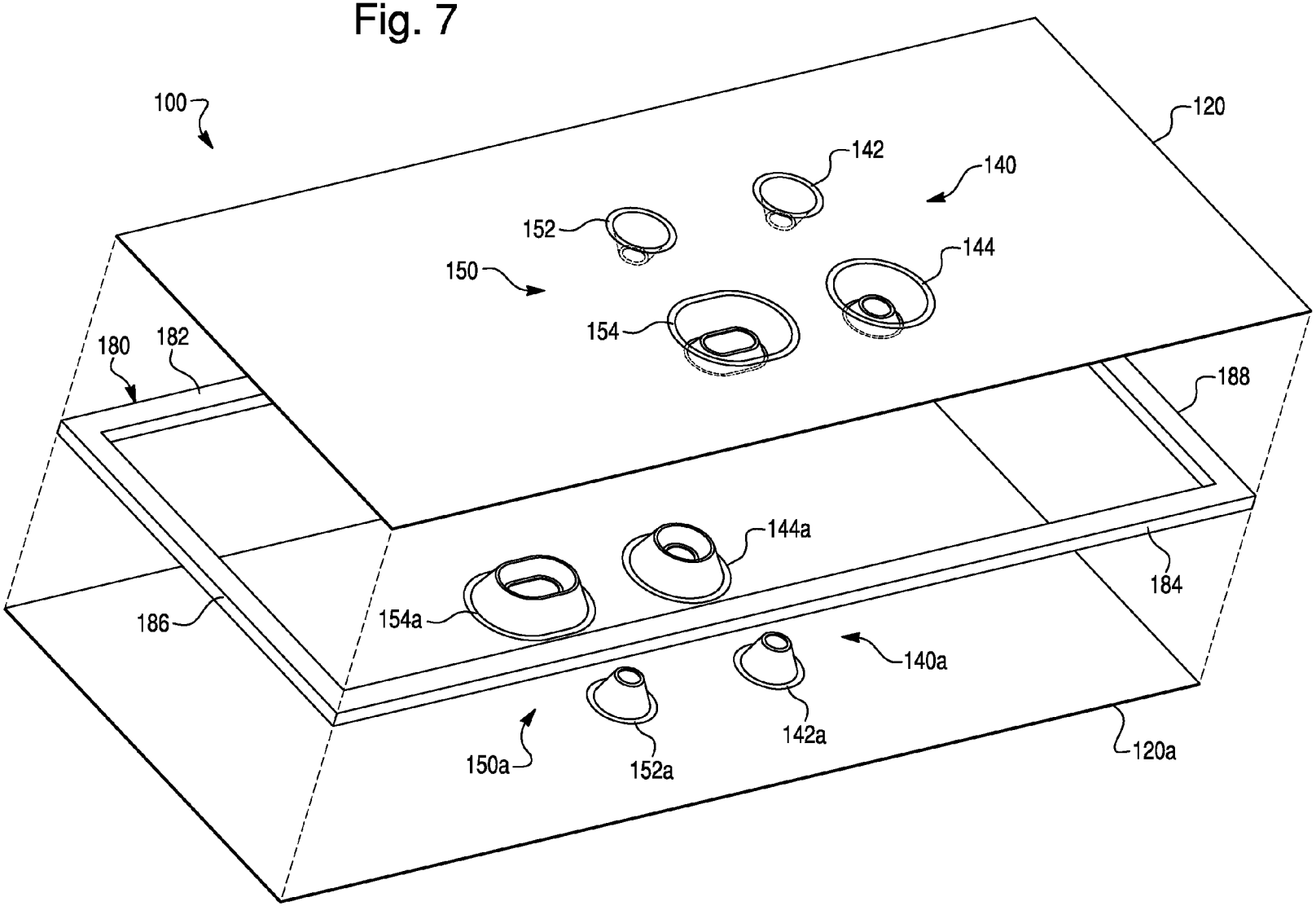
FIG. 7 is an assembly view of a door according to an exemplary embodiment of the invention.

A door assembly according to an exemplary embodiment of the invention is shown in FIG. 7 and generally designated by reference numeral 100. The door assembly 100 includes a molded first door facing 120 and a molded second door facing 120*a*. The first door facing 120 includes a first set of alignment members 140 and a second set of alignment members 150. The first and second sets of alignment members 140, 150 shown in FIG. 7 are similar to those shown in FIG. 3. The first set 140 includes a male alignment member 142 and a female alignment member 144, while the second set 150 has a male alignment member 152 and a female alignment member 154. The second door facing 120*a* similarly includes first and second sets of alignment members 140*a*, 150*a*. The first set 140*a* includes a male alignment member 142*a* and a female alignment member 144*a*, while the second set 150*a* includes a male alignment member 152*a* and a female alignment member 154*a*.

The door assembly 100 further includes a frame 180. In the illustrated embodiment of FIG. 7, the frame 180 includes a hinge stile 182, a lock stile 184, a bottom rail 186, and a top rail 188 collectively arranged to establish a rectangular support. The hinge and lock stiles 182, 184 are generally vertical and parallel to one another. The bottom and top rails 186, 188 are located at opposite ends of the stiles 182, 184, and are generally parallel to one another and perpendicular to the stiles 182, 184. Although not shown, the frame 180 may include intermediate stiles and/or rails, e.g., to enhance reinforcement or facilitate installation of other door components such as door locks.

The first and second door facings 120, 120*a* are attached to opposite sides of the frame in substantially parallel relationship to one another. Alignment of the door facings 120, 120*a* during attachment is facilitated by aligning and mating the male alignment members 142, 152 of the first door facing 120 with the female alignment members 144a, 154*a* of the second door facing 120*a*, and simultaneously aligning and mating the male alignment members 142*a*, 152*a* of the second door facing 120*a* with the female alignment members 144, 154 of the first door facing 120. The depths of mating pairs of alignment members (i.e., 142 and 144*a;* 144 and 142*a;* 152 and 154*a;* and 154 and 152a) match the depth of the frame 180 so that the major surface areas of both door facings 120, 120*a* lie in respective parallel planes.

The order of construction is not particularly limited. The door facings 120, 120*a* may be simultaneously attached to the door frame 180 and mated with one another. Alternatively, the door facings 120, 120*a* may be mounted on the door frame 180 consecutively, e.g., mounting the first door facing 120 on the door frame 180, then mounting the second door facing 120*a* on the door frame 180 while mating counterpart alignment members to ensure correct alignment. The door facings 120, 120*a* may be attached to the frame 180 via adhesion, bonding agent(s), mechanical fasteners, or any other suitable technique. In various embodiments the alignment assemblies will prevent the door facings 120, 120*a* from being offset from one another by a tolerance of approximately 0.01 inches (0.254 mm). After the facings 120, 120*a* are attached to one another and the door frame 180, an area around the alignment assemblies (corresponding to the area defined by dashed line 26 in FIG. 3) may be removed to form an opening (e.g., 24) for an insert such as a window (e.g., 16) or other design element.

Additionally, if so desired, a core component (not shown) may be placed between the door facings 120, 120*a*. The core component may be inserted between the door facings 120, 120*a* prior to attachment of the door facings 120, 120*a* to one another and the door frame 180. In an exemplary embodiment, a first door facing 120 is attached to the frame 180. A core component is then placed into the frame 180 so that the sets of alignment members 140, 150 are left uncovered. The second door facing 120*a* is then attached to the opposite side of the door frame 180 so that the sets of alignment 140, 150 of the first door facing 120 mate with the counterpart sets of alignment members 140*a,* 150*a* of the second door facing 120*a*.

In an alternative embodiment, the core component may be inserted or formed in situ after the door facings 120, 120*a* have been mounted on the door frame 180. In this alternative embodiment, the door facings 120, 120*a* are attached to the frame 180 and an area around the mated alignment members is removed. A core component (not shown) can be introduced into the hollow space between the door facings 120, 120*a* before or after the mated alignment members are removed from the remainder of the door facings.

The core component may be, for example, corrugated cardboard, paper, fiberboard, insulation, foam or any material suitable for enhancing the features of the door 100. The core component may provide a variety of features to the door 100 including: increased weight to simulate the density of solid wood or other materials; impact resistance, noise reduction, temperature control, and fire resistance; improved durability and compliance with local building requirements; and/or other features.

The foregoing description of the exemplary embodiments of the present invention has been presented for the purpose of illustration. It is not intended to be exhaustive or to limit the invention to the precise forms disclosed. Modifications and variations are possible in light of the above teachings. For example, the door assembly may be a "frameless" door assembly. For example, the outer edges of the door facings may have continuous rims extending generally perpendicular to the plane of the door facing bodies, wherein the rims of the door facings abut against one another when the alignment members of the door facings are mated.

The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. Moreover, features or components of one embodiment may be provided in another embodiment. Thus, the present invention is intended to cover all such modification and variations.

What is claimed is:

1. A door facing comprising:

a body portion comprising a first surface with a substantially planar main surface area, and an oppositely disposed second surface;

a male alignment member protruding relative to the substantially planar main surface area; and a female alignment member protruding relative to the substantially planar main surface area, wherein the male and female alignment members are constructed and arranged so that, when the door facing is placed in opposing relationship with second door facing having counterpart male and female alignment members to the door facing, the male and female alignment members of the door facing align and mate with the counterpart female and male alignment members, respectively, wherein the male alignment member comprises a circular pin and the female alignment member comprises a circular locator, and wherein both the male alignment member and the female alignment member are frustoconical in shape and differ in shape from one another, and wherein the male and female alignment members are positioned within a removable perforated area of the body portion.

2. The door facing according to claim 1, wherein the male and female alignment members are positioned in vertical symmetry with respect to one another.

3. The door facing according to claim 1, wherein the door facing is molded from a polymeric material.

4. The door facing according to claim 3, wherein the male and female alignment members are integrally molded with the body portion as a monolithic structure.

5. The door facing according to claim 1, wherein the female alignment member comprises an obround locator.

6. A door facing comprising:

a body portion comprising a first surface having a substantially planar main surface area, and an oppositely disposed second surface;

a first set of alignment members comprising a first male alignment member and a first female alignment member protruding relative to the substantially planar main surface area in a first direction; and a second set of alignment members comprising a second male alignment member and a second female alignment member protruding relative to the substantially planar main surface area in the first direction, wherein the first and second sets of alignment members are constructed and arranged so that, when the first surface of the door facing is placed in opposing relationship with a first surface of a second door facing having counterpart first and second male alignment members and counterpart first and second female alignment members, the male and female alignment members of the door facing align and mate with the counterpart female and male alignment members, respectively, and wherein the first and second sets of alignment members are constructed and arranged so that, when the door facing is placed in the same direction which is opposite to the opposing relationship with the second door facing having counterpart first and second male alignment members and counterpart first and second female alignment members, the male and female alignment members of the door facing align and nest with the counterpart male and female alignment members, respectively, so that the first and second door facings may be nested to reduce a space of nested door facings, and wherein the first male alignment member comprises a first circular pin and the first female alignment member comprises a circular locator having a different shape than the first circular locator.

7. The door facing according to claim 6, wherein the first male and first female alignment members are positioned in vertical symmetry with respect to one another, and further wherein the second male and the second female alignment members are positioned in vertical symmetry with respect to one another.

8. The door facing according to claim 6, wherein the first and second sets of alignment members are positioned within a removable perforated area of the body portion.

9. The door facing according to claim 6, wherein the door facing is molded from a polymeric material.

10. The door facing according to claim 9, wherein the first and second sets of alignment members are integrally molded with the body portion as a monolithic structure.

11. The door facing according to claim 6, wherein the second male alignment member comprises a second circular pin and the second female alignment member comprises an obround locator.

12. The door facing according to claim 11, wherein the first circular pin comprises a first frusto-conical projection and the circular locator comprises a frusto-conical projection.

13. The door facing according to claim 12, wherein the second circular pin comprises a second frusto-conical projection and the obround locator comprises a projection having a truncated top.

14. The door facing according to claim 13, wherein the circular locator further comprises an inwardly facing frusto-conical detent and the obround locator further comprises an inwardly facing detent.

15. A door assembly, comprising:

a first door facing comprising a first body portion comprising a first interior surface with a first substantially planar main surface area, and an oppositely disposed first exterior surface;

a first male alignment member protruding relative to the first substantially planar main surface area; and a first female alignment member protruding relative to the first substantially planar main surface area; and a second door facing oppositely disposed relative to the first door facing, the second door facing comprising a second body portion comprising a second interior surface with a second substantially planar main surface area, and an oppositely disposed second exterior surface;

a second male alignment member protruding relative to the second substantially planar main surface area and mating with the first female alignment member; and a second female alignment member protruding relative to the second substantially planar main surface area and mating with the first male alignment member, a frame interposed between the first and second door facings to establish a peripheral edge of the door assembly, wherein the first and second door facings are adhered to the frame by adhesive, wherein the male alignment members each comprise a respective circular pin and the female alignment members each comprise a respective circular locator having a shape that differs from the circular pin of the male alignment members, and wherein the first and second male alignment members and the first and second female alignment members are positioned within removable perforated areas of the first and second body portions.

16. The door assembly according to claim 15, wherein the first and second male alignment members are positioned in vertical symmetry with respect to the first and second female alignment members, respectively.

17. The door assembly according to claim 15, wherein the first and second door facings are molded from a polymeric material.

18. The door assembly according to claim 17, wherein the first male and first female alignment members are integrally molded with the first body portion as a first monolithic structure, and wherein the second male and second female alignment members are integrally molded with the second body portion as a second monolithic structure.

19. The door assembly according to claim 15, wherein the male alignment members each comprise a respective circular pin and the female alignment members each comprises a respective obround locator.

20. The door assembly according to claim 15, wherein:

the first door facing further comprises a third male alignment member protruding relative to the first substantially planar main surface area; and a third female alignment member protruding relative to the first substantially planar main surface area; and the second door facing further comprises a fourth male alignment member protruding relative to the second substantially planar main surface area and mating with the third female alignment member; and a fourth female alignment member protruding relative to the second substantially planar main surface area and mating with the third male alignment member.

21. The door assembly according to claim 20, wherein the first, second, third and fourth male alignment members are positioned in vertical symmetry with respect to the first, second, third, and fourth female alignment members, respectively.

22. The door assembly according to claim 21, wherein the first, second, third, and fourth male alignment member and the first, second, third, and fourth female alignment members are positioned within removable perforated areas of the first and second body portions.

23. The door assembly according to claim 20, wherein the first and second door facings are molded from a polymer material.

24. The door assembly according to claim 23, wherein the first and third male alignment members and the first and third female alignment members are integrally molded with the first body portion as a first monolithic structure, and wherein the second and fourth male alignment members and the second and fourth female alignment members are integrally molded with the second body portion as a second monolithic structure.

25. The door assembly according to claim 20, wherein the male alignment members each comprise a respective circular pin and the female alignment members each comprise a respective circular locator.

26. The door assembly according to claim 20, wherein the male alignment members each comprise a respective circular pin and the female alignment members each comprises a respective obround locator.

27. The door assembly according to claim 20, wherein the male alignment members each comprise a circular pin, the first and second female alignment members each comprise a circular locator, and the third and fourth female alignment members each comprise an obround locator.

28. The door assembly according to claim 27, wherein each of the circular pins comprises a frusto-conical projection, each of the circular locators comprises a frusto-conical projection, and each of the obround locators comprises a projection having a truncated top.

29. The door assembly according to claim 28, wherein each of the circular locators further comprises an inwardly facing frusto-conical detent and each of the obround locators further comprises an inwardly facing detent.

30. The door assembly according to claim 20, wherein the first male and female alignment members are identical to the second male and female alignment members and the third male and female alignment members are identical to the fourth male and female alignment members.

* * * * *